US008960671B2

(12) United States Patent
Sugimoto

(10) Patent No.: US 8,960,671 B2
(45) Date of Patent: Feb. 24, 2015

(54) SHEET-CONVEYING DEVICE HALTING BRUSHED MOTOR IN DIFFERENT METHODS

(71) Applicant: Tasuku Sugimoto, Nagoya (JP)

(72) Inventor: Tasuku Sugimoto, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/728,401

(22) Filed: Dec. 27, 2012

(65) Prior Publication Data

US 2013/0168923 A1 Jul. 4, 2013

(30) Foreign Application Priority Data

Dec. 28, 2011 (JP) ..... 2011-289165

(51) Int. Cl.

| | |
|---|---|
| ***B65H 7/02*** | (2006.01) |
| ***B65H 7/06*** | (2006.01) |
| ***B65H 5/06*** | (2006.01) |
| ***B65H 5/26*** | (2006.01) |

(52) U.S. Cl.

CPC ..... *B65H 7/06* (2013.01); *B65H 5/062* (2013.01); *B65H 5/26* (2013.01); *B65H 2407/21* (2013.01); *B65H 2511/20* (2013.01); *B65H 2511/414* (2013.01); *B65H 2513/222* (2013.01); *B65H 2513/511* (2013.01); *B65H 2553/82* (2013.01); *B65H 2555/25* (2013.01); *B65H 2701/1311* (2013.01); *B65H 2701/1313* (2013.01)

USPC ..... 271/259; 271/258.03; 318/538; 318/365; 399/18

(58) Field of Classification Search

CPC .... B65H 43/02; B65H 43/04; B65H 4303/92; B65H 4404/105; B65H 2513/222; B65H 2513/512; B65H 2513/322; B65H 2601/423; B65H 2601/24; B65H 2601/522

USPC ..... 271/259, 258.01, 258.03; 318/538, 541, 318/364–369; 399/18, 21

See application file for complete search history.

(56) References Cited

U.S. PATENT DOCUMENTS

| | | | | |
|---|---|---|---|---|
| 7,584,951 | B2 * | 9/2009 | Otani et al. | 271/265.01 |
| 7,686,301 | B2 * | 3/2010 | Kakishima | 271/265.01 |
| 7,762,733 | B2 * | 7/2010 | Kakishima et al. | 318/599 |
| 2003/0184002 | A1 * | 10/2003 | Akiyama et al. | 271/110 |
| 2006/0022401 | A1 * | 2/2006 | Akiyama et al. | 271/265.01 |

FOREIGN PATENT DOCUMENTS

| | | | |
|---|---|---|---|
| JP | H2-163244 | A | 6/1990 |
| JP | 2001-348129 | A | 12/2001 |

* cited by examiner

*Primary Examiner* — Gerald McClain

(74) *Attorney, Agent, or Firm* — Scully, Scott, Murphy & Presser, PC

(57) ABSTRACT

A sheet conveying device includes a conveying path, a brushed motor, a motor drive unit, a conveying unit, a sensor, and a processor. The motor drive unit is configured to rotate and halt the brushed motor. The conveying unit is configured to convey a sheet along the conveying path by driving force of the motor. The sensor is configured to detect the sheet. The processor is configured to function as a halting unit configured to control the motor drive unit to halt the brushed motor in different methods depending on detection result of the sensor.

7 Claims, 8 Drawing Sheets

SHEET-CONVEYING DEVICE HALTING BRUSHED MOTOR IN DIFFERENT METHODS

CROSS REFERENCE TO RELATED APPLICATION

This application claims priority from Japanese Patent Application No. 2011-289165 filed Dec. 28, 2011. The entire content of the priority application is incorporated herein by reference.

TECHNICAL FIELD

The present invention relates to the rotational control of a brushed motor used as a drive source for conveying sheets.

BACKGROUND

Some recording devices known in the art immediately halt their sheet-conveying mechanism when a sheet becomes jammed along the conveying path. In some cases, the drive source of the sheet-conveying mechanism is a brushed motor. A shortcoming of brushed motors is that their lifespan is shorter than that of brushless motors because of wear caused by contact between the brushes and commutators.

SUMMARY

Since the mechanism of the prior art described above uses a brushed motor as the drive source for driving the sheet-conveying mechanism, the amount of wear on the brushes is increased if the recording device always urgently halts the mechanism when a paper jam or other sheet-conveying abnormality occurs, further shortening the lifespan of the motor.

Therefore, it is an object of the present invention to provide a technique for reducing the effects of operations for halting the sheet-conveying mechanism when a sheet-conveying abnormality occurs on the lifespan of a brushed motor.

In order to attain the above and other objects, the invention provides a sheet conveying device. The sheet conveying device includes a conveying path, a brushed motor, a motor drive unit, a conveying unit, a sensor, and a processor. The motor drive unit is configured to rotate and halt the brushed motor. The conveying unit is configured to convey a sheet along the conveying path by driving force of the motor. The sensor is configured to detect the sheet. The processor is configured to function as a halting unit configured to control the motor drive unit to halt the brushed motor in different methods depending on detection result of the sensor.

According to another aspect, the present invention provides a non-transitory computer readable storage medium storing a set of program instructions installed on and executed by a computer for controlling a sheet conveying device including a conveying path; a brushed motor; a motor drive unit configured to rotate and halt the brushed motor; a conveying unit configured to convey a sheet along the conveying path by driving force of the motor; a sensor configured to detect the sheet; and a processor. The program instructions includes controlling the motor drive unit to halt the brushed motor in different methods depending on detection result of the sensor.

BRIEF DESCRIPTION OF THE DRAWINGS

The particular features and advantages of the invention as well as other objects will become apparent from the following description taken in connection with the accompanying drawings, in which.

DETAILED DESCRIPTION

The sheet-conveying mechanism according to an embodiment is a printer 1, and specifically an electrophotographic image-forming device.

Mechanical Structure of the Printer

Figure 1:
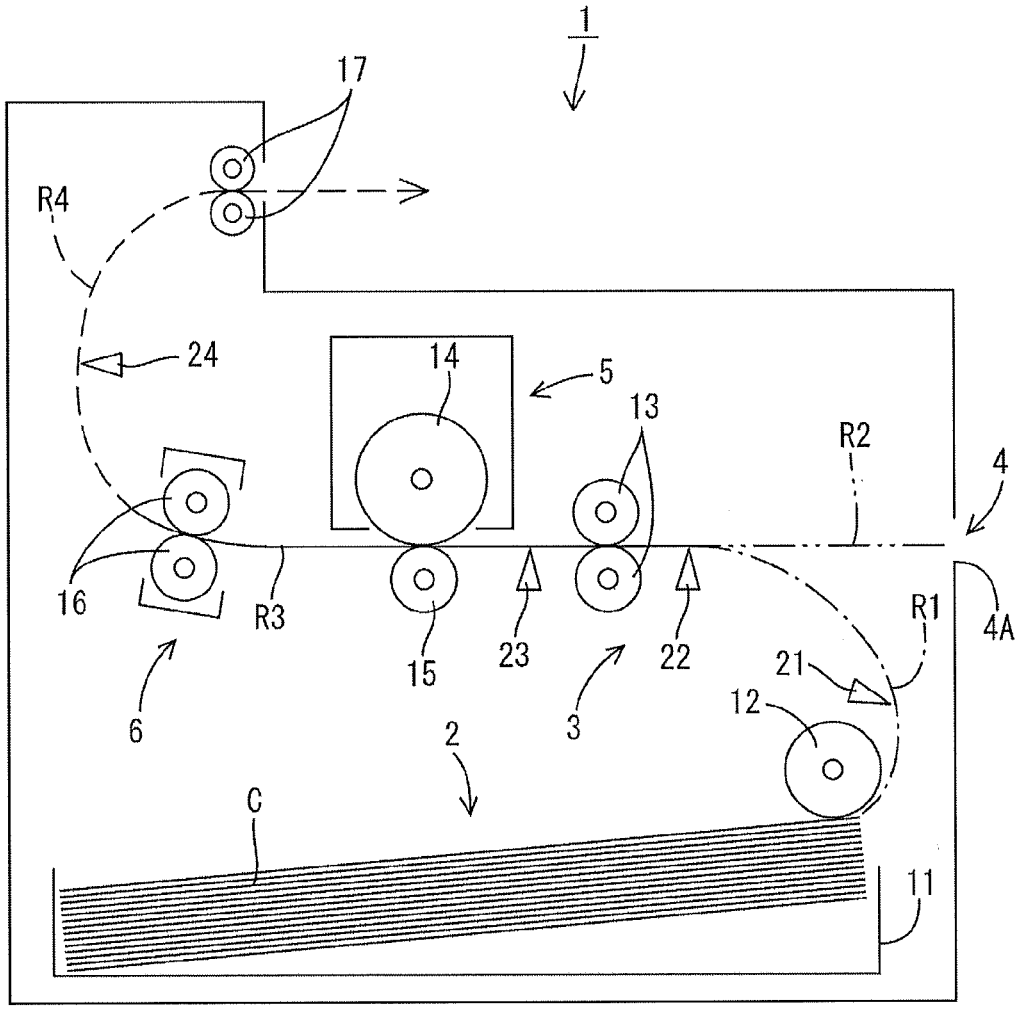
FIG. 1 is a cross section of a printer illustrating an internal structure thereof according to an embodiment of a present invention.

As shown in FIG. 1, the printer 1 includes a sheet-supplying unit 2, a conveying mechanism 3, a manual-feed insertion unit 4, an image-forming unit 5, and a fixing unit 6. The printer 1 functions to form toner images on sheets C based on image data inputted from an external source or the like. The sheets C may be sheets of paper or sheets of another medium, such as transparencies.

The sheet-supplying unit 2 is provided in the bottommost section of the printer 1 and includes a cassette 11 capable of accommodating a plurality of sheets C. The conveying mechanism 3 includes a pick-up roller 12, registration rollers 13, a photosensitive member 14, a transfer roller 15, heating rollers 16, and discharge rollers 17. The pick-up roller 12 picks up the sheets C accommodated in the cassette 11 one sheet at a time and conveys the sheets C to the registration rollers 13. Hereinafter, the operation for supplying a sheet C from the cassette 11 to the registration rollers 13 will be referred to as a cassette-feed operation, and the conveying path of the sheet C for this operation will be called the cassette-feed path R1. That is, the cassette-feed path R1 is defined from the pick-up roller 12 to the registration rollers 13.

The manual-feed insertion unit 4 has an insertion opening 4A through which the user manually inserts the sheets C. The sheets C inserted through the insertion opening 4A are supplied directly to the registration rollers 13. Hereinafter, the operation for supplying a sheet C to the registration rollers 13 through the insertion opening 4A will be called a manual-feed operation, and the conveying path of the sheet C during this operation will be called the manual-feed path R2. That is, the manual-feed path R2 is defined from the opening 4*a* to the registration rollers 13. The cassette-feed path R1 and the manual-feed path R2 converge at a position just upstream of the registration rollers 13.

The registration rollers 13 correct skew in a cassette-fed or manually-fed sheet C and convey the sheet C to a transfer position between the photosensitive member 14 and the transfer roller 15. The photosensitive member 14 and the transfer roller 15 form a toner image on the sheet C at the transfer position, while conveying the sheet C to the fixing unit 6. Hence, the photosensitive member 14 and the transfer roller 15 are components of both the image-forming unit 5 and the conveying mechanism 3. In addition to the photosensitive member 14 and the transfer roller 15, the image-forming unit 5 includes a charger, a exposure device, a developing roller, a toner box, and other components not shown in the drawings.

The heating rollers 16 fix the toner image to the sheet C conveyed to the fixing unit 6 with heat while continuing to convey the sheet C to the discharge rollers 17. Hence, the heating rollers 16 are components of both the fixing unit 6 and the conveying mechanism 3. The discharge rollers 17 receive the sheet C conveyed by the heating rollers 16 and discharge the sheet C onto the top surface of the printer 1. Hereinafter, the conveying path of the sheet C from the registration rollers 13 to the heating rollers 16 will be called the process path R3, while the conveying path from the heating rollers 16 to the discharge rollers 17 will be called the discharge path R4.

The printer 1 also includes a trailing edge sensor 21, a pre-registration sensor 22, a post-registration sensor 23, and a discharge sensor 24.

The sensing region of the trailing edge sensor 21 is on the cassette-feed path R1 downstream of the pick-up roller 12. The trailing edge sensor 21 outputs detection results indicating whether the trailing edge of a cassette-fed sheet C has been detected. These detection results are used for determining whether a sheet is jammed in the cassette-feed path R1, for setting the timing to begin conveying the next sheet C from the cassette 11, for measuring the length of the sheet C in the conveying direction, and the like.

The sensing region of the pre-registration sensor 22 is in the region at which the cassette-feed path R1 and the manual-feed path R2 converge on the upstream side of the registration rollers 13. The pre-registration sensor 22 outputs detection results indicating whether the leading edge of a cassette-fed or manually-fed sheet C has been detected. These detection results are used for determining whether a sheet is jammed in the converging region of the cassette-feed path R1 and manual-feed path R2, for setting the timing to resume rotation of the registration rollers 13, for detecting the presence of a sheet C inserted through the insertion opening 4A, for measuring the length of the sheet C in the conveying direction, and the like.

The sensing region of the post-registration sensor 23 lies on the process path R3 downstream of the registration rollers 13, that is, in a region after the sheet has been registered. The post-registration sensor 23 outputs detection results indicating whether the leading edge of a sheet C conveyed by the registration rollers 13 has been detected. These detection results are used for determining whether a sheet is jammed in the process path R3, for setting the timing for initiating image formation with the image-forming unit 5, for measuring the length of the sheet C in the conveying direction, and the like.

The sensing region of the discharge sensor 24 is positioned on the discharge path R4 downstream of the fixing unit 6. The discharge sensor 24 outputs detection results indicating whether the trailing edge of a sheet C discharged from the fixing unit 6 has been detected. These detection results are used for determining whether a sheet is jammed in the discharge path R4, for detecting whether a cover (not shown) of the fixing unit 6 is open or closed, and the like.

Electrical Structure of the Printer

Figure 2:
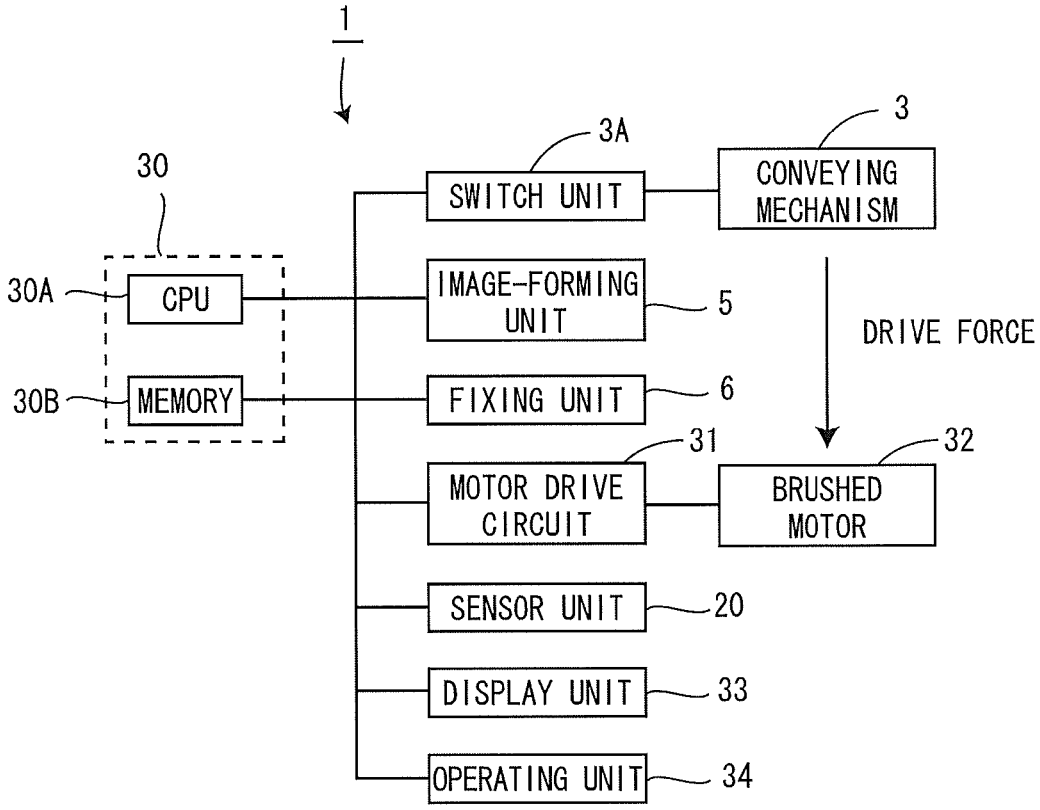
FIG. 2 is a block diagram illustrating an electrical structure of the printer.

As shown in FIG. 2, the printer 1 includes a control unit 30. The control unit 30 has a central processing unit (CPU) 30A and a memory unit 30B. The memory unit 30B stores various programs for controlling operations of the printer 1. The CPU 30A controls the components of the printer 1 based on programs read from the memory unit 30B. The memory unit 30B includes RAM and ROM. However, in addition to RAM and the like, the medium storing the various programs may be any nonvolatile memory, such as a CD-ROM, hard disk drive, flash memory (registered trademark), and the like.

The control unit 30 controls operations of a switch unit 3A, the image-forming unit 5 and the fixing unit 6 described above, a motor drive circuit 31, a sensor unit 20, a display unit 33, and an operating unit 34. The switch unit 3A has a plurality of switch elements configured of solenoid switches, electromagnetic switches, and the like, and controls whether the drive force of a brushed motor 32 is transmitted to the various rollers 12-17 of the conveying mechanism 3. The motor drive circuit 31 supplies a drive current to the brushed motor 32 for driving the brushed motor 32 to rotate. The motor drive circuit 31 also has an H-bridge circuit 35 shown in FIG. 3, enabling the motor drive circuit 31 to drive the brushed motor 32 to rotate in both forward and reverse directions. The brushed motor 32 has a configuration well known in the art and includes commutators and brushes that contact one another. Hereinafter, the brushed motor 32 will simply be called the motor 32.

In addition to the various sensors 21-24 described above, the sensor unit 20 includes a sensor drive circuit (not shown) for controlling light emission and reception operations of each sensor. The display unit 33 includes a screen, lamps, and the like for displaying various option menus, the operational status of the device, and the like. The operating unit 34 is configured of a plurality of buttons by which the user can input various instructions and settings.

Structure of the Motor Drive Circuit and Halting Operations Performed Thereby

Figure 3:
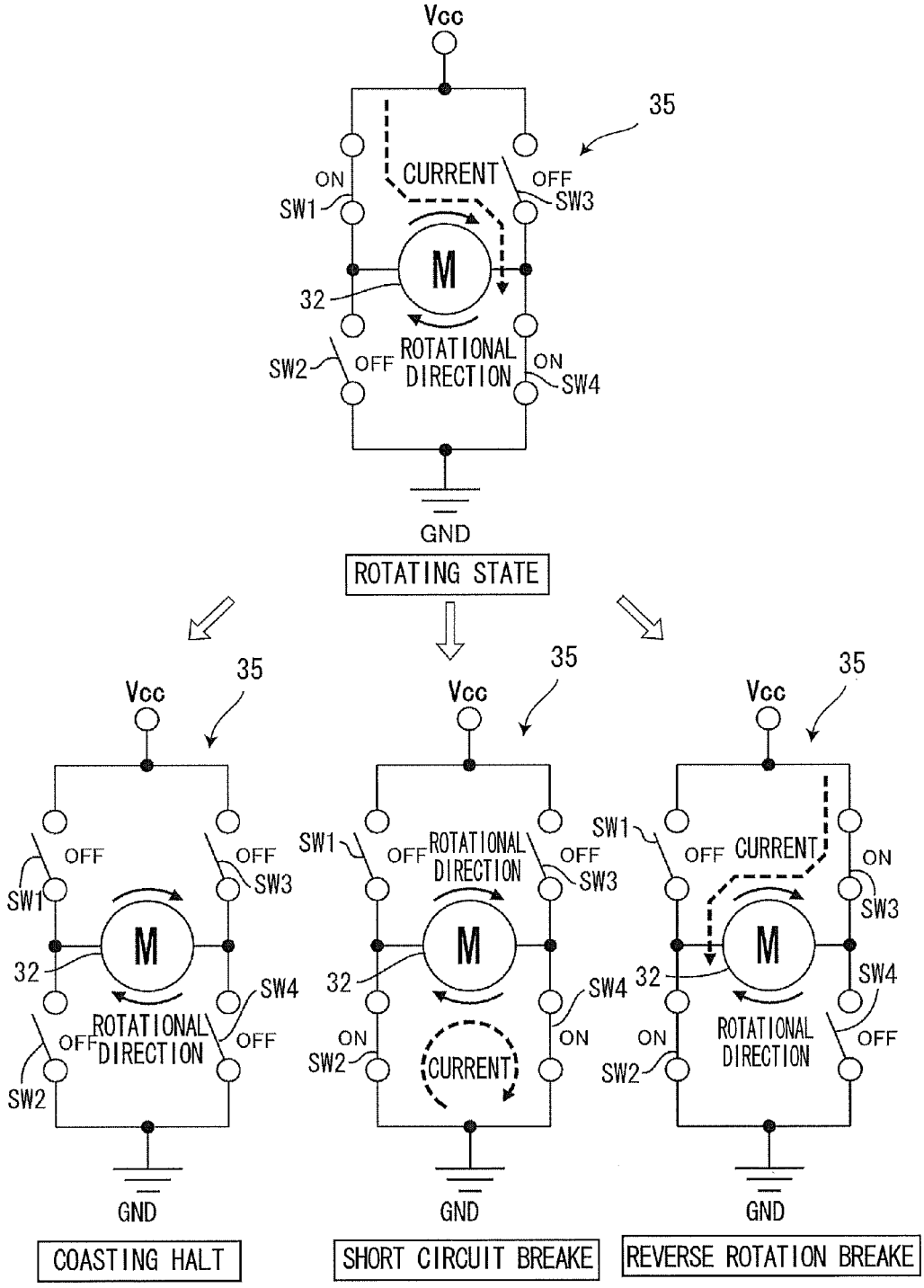
FIG. 3 is an explanation diagram illustrating a overview structure of an H-bridge circuit in a motor drive circuit and its operational states during halting operations.

FIG. 3 shows the general structure of the motor drive circuit 31 and its operational states during halting operations. The motor drive circuit 31 includes the H-bridge circuit 35, well known in the art, having four switches SW1-SW4. With the H-bridge circuit 35, the motor drive circuit 31 can drive the motor 32 to rotate in both forward and reverse directions. Therefore, the motor drive circuit 31 can execute a plurality of halting operations for halting the motor 32, each of which has a different deceleration force. The plurality of halting operations shown in FIG. 3 include a coasting halt in which the motor continues to spin briefly by its own inertia after the motor drive circuit 31 stops driving the same, a short-circuit brake, and a reverse-rotation brake.

The top drawing in FIG. 3 shows the states of switches in the H-bridge circuit 35 while the H-bridge circuit 35 is being driven to rotate. At this time, the switches SW1 and SW4 are on while the switches SW2 and SW3 are off, causing the motor 32 to rotate clockwise. In this state, the drive force of the motor 32 rotates the rollers 12-17, enabling the conveying mechanism 3 to convey a sheet C along the conveying path.

The lower-left drawing in FIG. 3 shows the states of switches in the H-bridge circuit 35 during a coasting halt operation. In this case, all switches SW1-SW4 are off. When the switches in the H-bridge circuit 35 are changed from a rotating state to a coasting halt state, the drive current no longer flows in the motor 32, and the motor 32 continues to rotate from its moment of inertia while gradually decelerating until coming to a complete stop.

The lower-center drawing of FIG. 3 shows the states of switches in the H-bridge circuit 35 during a short-circuit brake operation. In this case, the switches SW1 and SW3 are off while the switches SW2 and SW4 are on. When switches of the H-bridge circuit 35 are changed from a rotating state to a short-circuit brake state, the induced voltage generated in the motor 32 causes the electric current to flow into a closed circuit formed by the motor 32 and the switches SW2 and SW4, consuming all the rotational energy of the motor 32. When the rotational energy of the motor 32 is consumed, the motor 32 receives a deceleration force and comes to a halt.

The lower-right drawing of FIG. 3 shows the states of switches in the H-bridge circuit 35 during a reverse-rotation brake operation. In this case, the switches SW1 and SW4 are off while the switches SW2 and SW3 are on. When the switches of the H-bridge circuit 35 are changed from a rotating state to a reverse-rotation brake state, the motor 32 incurs a deceleration force from the rotational energy based on the reverse current and comes to a halt. The deceleration force of the reverse-rotation brake is stronger than that of the short-circuit brake, while the deceleration force of the short-circuit brake is stronger than that in a coasting halt.

Rotational Control of the Motor

Figure 4:
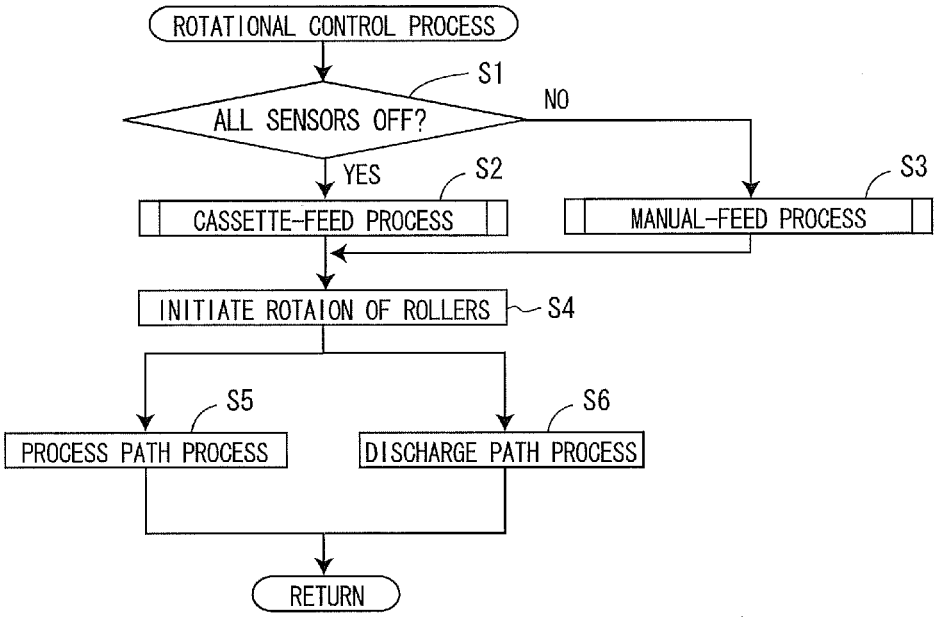
FIG. 4 is a flowchart illustrating a rotational control process for motor.

When the power for the printer 1 is turned on, the CPU 30A reads the above programs from the memory unit 30B and executes a rotational control process for the motor, as indicated in the flowchart of FIG. 4. In S1 of the process shown in FIG. 4, the CPU 30A determines whether all of the sensors 21-24 are off, i.e., whether all of the sensors 21-24 are outputting detection results indicating sheet-not-present.

(1) Cassette-Feed Process

Figure 5:
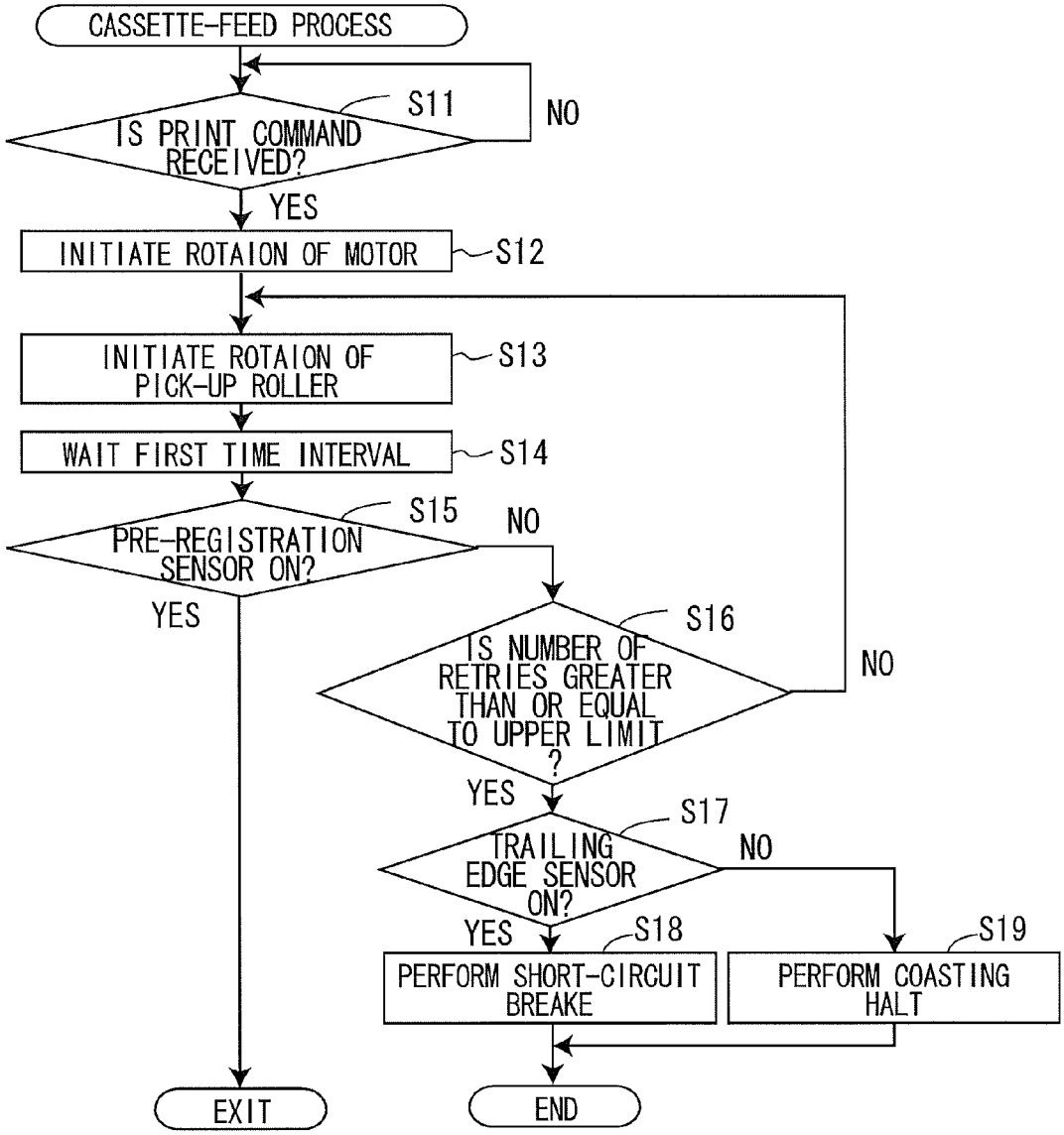
FIG. 5 is a flowchart illustrating a cassette-feed process.

If the CPU 30A determines that all of the sensors 21-24 are off (S1: YES), in S2 the CPU 30A executes the cassette-feed process shown in FIG. 5. As shown in FIG. 5, in S11 of the cassette-feed process, the CPU 30A determines whether a print command was received from an external device or through a user input operation on the operating unit 34 and continues to wait while a print command has not been received (S11: NO). When a print command is received (S11: YES), in S12 the CPU 30A controls the motor drive circuit 31 to perform an operation for driving the motor 32 to rotate. Note that the state of the switch unit 3A at this time is such that the drive force of the motor 32 is not transmitted to the rollers 12-17. In S13 the CPU 30A performs an operation to turn on the switch element for transmitting the drive force to the pick-up roller 12. Consequently, the pick-up roller 12 rotates an amount sufficient for conveying one sheet C, and subsequently stops.

In S14 the CPU 30A waits a first time interval from the moment that the pick-up roller 12 begins to rotate. The first time interval is the time required from the moment the pick-up roller 12 begins rotating until the leading edge of the sheet C arrives at the sensing region of the pre-registration sensor 22. After waiting the first time interval, in S15 the CPU 30A determines whether the pre-registration sensor 22 is on. If the CPU 30A determines that the pre-registration sensor 22 is on (S15: YES), then the cassette-feed operation was performed normally and the current cassette-feed process ends. Subsequently, the CPU 30A returns to FIG. 4 to execute steps S4, S5, and S6.

However, if the CPU 30A determines that the pre-registration sensor 22 is off (S15: NO), in S16 the CPU 30A determines whether a number of retries exceeds an upper limit. If the number of retries is less than the upper limit (S16: NO), then it is possible that the pick-up roller 12 did not properly pick up and feed a sheet C. Here, the number of retries is the number of times the process returned to S13 from S16. Accordingly, the CPU 30A returns to S13 and attempts to drive the pick-up roller 12 to rotate again. If the CPU 30A determines that the number of retries exceeds the upper limit (S16: YES), in S17 the CPU 30A determines whether the trailing edge sensor 21 is on.

If the trailing edge sensor 21 is on (S17: YES), then there is a possibility that the sheet C became jammed on the cassette-feed path R1 upstream of the sensing region for the pre-registration sensor 22. This type of sheet jam is an example of a sheet-present conveying abnormality and hereinafter will be called a "cassette-feed jam." Consequently, in S18 the CPU 30A controls the motor drive circuit 31 to apply a short-circuit brake to the motor 32 and displays a message or the like on the display unit 33 indicating a cassette-feed jam has occurred. Subsequently, the CPU 30A ends the rotational control process for the motor.

However, if the trailing edge sensor 21 is off (S17: NO), then it is possible that a sheet C was not supplied into the cassette-feed path R1 because no sheets C remain in the cassette 11. This abnormality in which a sheet C cannot be supplied from the cassette 11 is an example of a sheet-not-present conveying abnormality and hereinafter will be called a "first sheet-not-present error." Since sheets C are not jammed on the cassette-feed path R1 in a first sheet-not-present error, there is no need to halt the motor 32 as urgently as in a cassette-feed jam. Consequently, in S19 the CPU 30A controls the motor drive circuit 31 to apply to the motor 32 a coasting halt having a weaker deceleration force than the short-circuit brake, and displays a message on the display unit 33 indicating that a first sheet-not-present error has occurred. Subsequently, the CPU 30A ends the rotational control process for the motor.

Thus, if a conveying abnormality occurs during the cassette-feed process when sheets C are present in the cassette-feed path R1, the motor 32 is halted with an operation using a stronger deceleration force than when an error occurs while no sheets C are present in the cassette-feed path R1. Hence, shortening of the lifespan of the motor 32 caused by halting operations when sheet conveying abnormalities occur can be suppressed more than when using a configuration that halts the motor 32 with the same strong deceleration force regardless of whether the conveying abnormality occurred with a sheet present or without a sheet present.

(2) Manual-Feed Process

Figure 6:
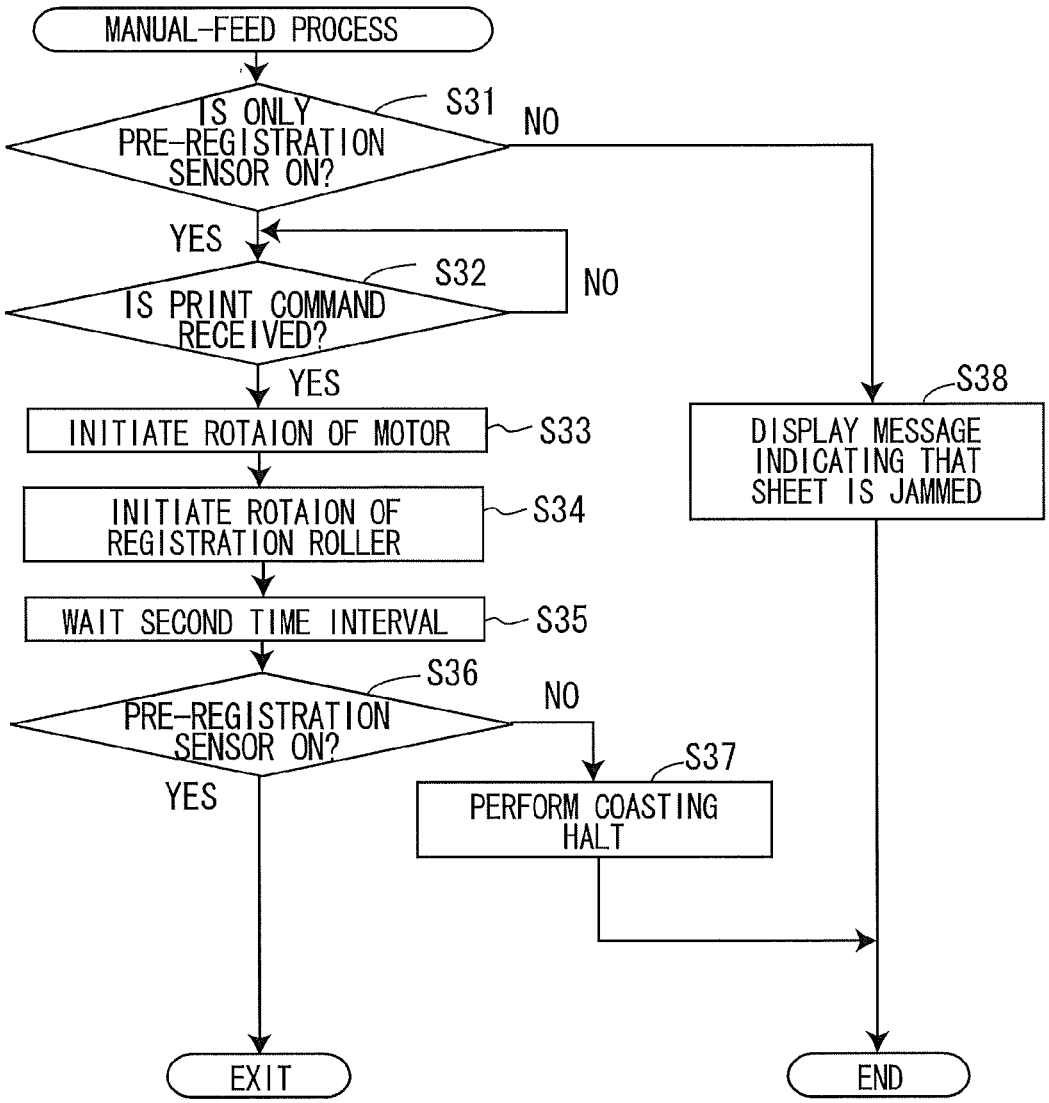
FIG. 6 is a flowchart illustrating a manual-feed process.

As shown in FIG. 4, if the CPU 30A determines in S1 that at least one of the sensors 21-24 is on (S1: NO), in S3 the CPU 30A executes the manual-feed process shown in FIG. 6. As shown in FIG. 6, in S31 of the process shown in FIG. 6, the CPU 30A determines whether only the pre-registration sensor 22 is on. If the pre-registration sensor 22 is the only sensor that is on (S31: YES), in S32 the CPU 30A waits while a print command has not been received (S32: NO). When a print command is received (S32: YES), in S33 the CPU 30A controls the motor drive circuit 31 to drive the motor 32 to rotate. Note that the state of the switch unit 3A at this time is such that the drive force of the motor 32 will not be transmitted to the rollers 12-17. In S34 the CPU 30A performs an operation to turn on the switch element for transmitting the drive force of the motor 32 to the registration rollers 13. Through this operation, the registration rollers 13 are rotated just enough to pull in the leading edge of the manually-fed sheet C a prescribed distance such that the leading edge portion of the sheet is positioned upstream of the sensing region of the post-registration sensor 23 in the conveying direction.

In S35 the CPU 30A waits a second time interval from the point that the registration rollers 13 began to rotate. The second time interval is the amount of time required to feed the leading edge portion of the sheet C to a position just before the sensing region of the post-registration sensor 23 from the point that the registration rollers 13 began to rotate. After the second time interval has elapsed, in S36 the CPU 30A determines whether the pre-registration sensor 22 is on. If the CPU 30A determines that the pre-registration sensor 22 is on (S36: YES), then the operation for drawing the manually-fed sheet C inside the machine was performed normally, and the CPU 30A ends the manual-feed process. Subsequently, the CPU 30A advances to perform steps S4 and S5 in FIG. 4.

However, if the CPU 30A determines that the pre-registration sensor 22 is off (S36: NO), then there is a possibility that the sheet C was not supplied onto the manual-feed path R2 because the user pulled the sheet C back out of the device. This type of abnormality that occurs when a sheet C is not fed is another example of a sheet-not-present conveying abnormality and hereinafter will be called a "second sheet-not-present error." Since there is no chance that a sheet C has become jammed on the conveying path when a second sheet-not-present error occurs, there is little need to halt the motor 32 urgently as during a cassette-feed jam. Therefore, in S37 the CPU 30A controls the motor drive circuit 31 to stop driving the motor 32 so that the motor 32 coasts to a stop, and displays a message on the display unit 33 indicating that a second sheet-not-present error has occurred. Subsequently, the CPU 30A ends the rotational control process for the motor.

On the other hand, if the CPU 30A determines in S31 that a sensor other than the pre-registration sensor 22 is on (S31: NO), then there is a possibility that a sheet jammed on one of the conveying paths R1-R4. Thus, in S38 the CPU 30A displays a message or the like on the display unit 33 to indicate a sheet has jammed, and subsequently ends the rotational control process for the motor.

After executing a cassette-feed process or a manual-feed process, in S4 of FIG. 4 the CPU 30A controls the sensor unit 20 to turn on switch elements needed for transmitting the drive force of the motor 32 to the registration rollers 13, the photosensitive member 14, the transfer roller 15, the heating rollers 16, and the discharge rollers 17. Thereafter, the CPU 30A executes a process path process (S5) and a discharge path process (S6) in parallel.

(3) Process Path Process

Figure 7:
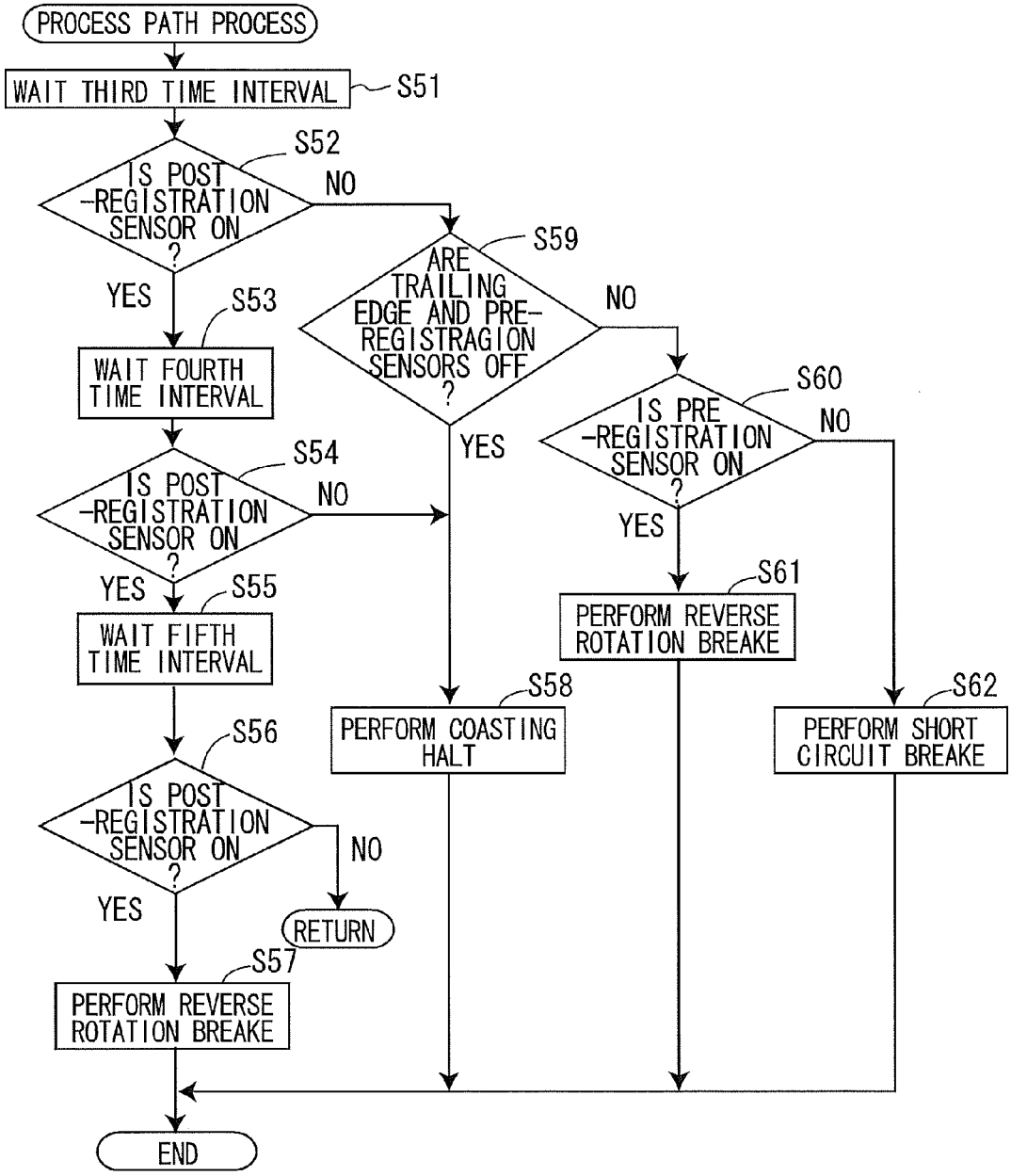
FIG. 7 is a flowchart illustrating a process path process.

In S51 at the beginning of the process in FIG. 7, the CPU 30A waits a third time interval after initiating rotation of the registration rollers 13 and the like in S4. The third time interval is the time required for the leading edge of the sheet C to arrive at the sensing region of the post-registration sensor 23 after the registration rollers 13 or the like have begun to rotate in S4. After waiting the third time interval, in S52 the CPU 30A determines whether the post-registration sensor 23 is on.

If the CPU 30A determines that the post-registration sensor 23 is on (S52: YES), in S53 the CPU 30A waits a fourth time interval. The fourth time interval is the amount of time required for the trailing edge of a sheet having the minimum dimension that can be used in the printer 1 to exit the sensing region of the post-registration sensor 23 from the moment that the post-registration sensor 23 turned on. The minimum dimension of sheets used in the printer 1 is based on the length of the sheet in the conveying direction.

In S54 the CPU 30A determines whether the post-registration sensor 23 is on after waiting the fourth time interval. If the CPU 30A determines that the post-registration sensor 23 is off (S54: NO), then it is possible that the conveying-direction length of the sheet C present in the process path R3 is shorter than the minimum dimension. This type of abnormality in which the supplied sheet is shorter than the minimum dimension that can be used in the printer 1 is another example of a sheet-present conveying abnormality and hereinafter will be called a "short-sheet error." Since the probability of the sheet C becoming jammed on the conveying path is low in the case of a short-sheet error, there is little need to halt the motor 32 urgently as there would be in a cassette-feed jam. Thus, in S58 the CPU 30A controls the motor drive circuit 31 to stop driving the motor 32 so that the motor 32 coasts to a stop, and displays a message on the display unit 33 indicating that a short-sheet error has occurred. Subsequently, the CPU 30A ends the rotational control process for the motor.

A conveying abnormality due to a short sheet is easier to resolve than a conveying abnormality due to a long sheet. Therefore, when the ON duration of the post-registration sensor 23 is less than the fourth time interval, the CPU 30A in the embodiment treats this event as a conveying error caused by a short sheet and halts the motor 32 with a comparatively weak halting operation. In this way, the printer 1 can minimize shortening of the lifespan of the motor 32 due to halting operations in the events of sheet-conveying abnormalities more so than a configuration that halts the motor 32 with the same deceleration force, regardless of the length of the sheet.

On the other hand, if the CPU 30A determines that the post-registration sensor 23 is on after waiting for the fourth time interval (S54: YES), in S55 the CPU 30A continues to wait for a fifth time interval. The total of the fourth and fifth time intervals is the amount of time required for the trailing edge of a sheet having the maximum dimension that can be used in the printer 1 to exit the sensing region of the post-registration sensor 23 from the moment that the post-registration sensor 23 turned on in S4. The maximum dimension of a sheet is based on the length of the sheet in the conveying direction and may be the length of an A4-size sheet, for example.

In S56 the CPU 30A determines whether the post-registration sensor 23 is on after waiting the fifth time interval. If the post-registration sensor 23 is on (S56: YES), there is a possibility that the conveying-direction length of the sheet C on the process path R3 is greater than the maximum dimension. An abnormality due to the length of the supplied sheet being greater than the maximum dimension that can be used in the printer 1 is another example of a sheet-present conveying abnormality and hereinafter will be called a "long-sheet error." Note that this long-sheet error includes a double-sheet feeding error in which two sheets C are conveyed while partially overlapped.

Since there is a high probability that the sheet C has become wrapped around or jammed in one of the rollers 13-16 in the event of a long-sheet error, urgently halting the motor 32 is more necessary than during a short-sheet error. Accordingly, in S57 the CPU 30A controls the motor drive circuit 31 to execute an operation to apply a reverse-rotation brake to the motor 32 and displays a message on the display unit 33 indicating a long sheet error has occurred. Subsequently, the CPU 30A ends the rotational control process for the motor. On the other hand, if the CPU 30A determines that the post-registration sensor 23 is off after waiting the fifth time interval (S56: NO), then the CPU 30A determines that the sheet C being conveyed has dimensions supported by the printer 1, ends the current process path process, and returns to S1 of FIG. 4.

A conveying abnormality due to a long sheet is more difficult to resolve than a conveying abnormality due to a short sheet. Therefore, when the ON duration of the post-registration sensor 23 is greater than or equal to the sum of the fourth and fifth time intervals, the CPU 30A in the embodiment determines that the conveying abnormality is due to a long sheet and halts the motor 32 using a relatively strong halting operation. In this way, the printer 1 can minimize shortening of the lifespan of the motor 32 due to halting operations in the events of sheet-conveying abnormalities more so than a configuration that halts the motor 32 using the same strong deceleration force, regardless of the length of the sheet.

On the other hand, if the CPU 30A determines in S52 that the post-registration sensor 23 is off (S52: NO), in S59 the CPU 30A determines whether both the trailing edge sensor 21 and the pre-registration sensor 22 are off. If the CPU 30A determines that both the trailing edge sensor 21 and pre-registration sensor 22 are off (S59: YES), there is a possibility that the user pulled the sheet C out of the printer 1 and that no sheet C is present in the cassette-feed path R1 or the manual-feed path R2. This abnormality is an example of a sheet-not-present conveying abnormality and hereinafter will be called a "third sheet-not-present error." Since there is no chance that a sheet C is jammed in the conveying path in the case of a third sheet-not-present error, in S58 the CPU 30A controls the motor drive circuit 31 to stop driving the motor 32 so that the motor 32 coasts to a stop, and displays a message on the display unit 33 indicating that a third sheet-not-present error has occurred. Subsequently, the CPU 30A ends the rotational control process for the motor.

If the CPU 30A determines that one of the trailing edge sensor 21 and the pre-registration sensor 22 is on (S59: YES), in S60 the CPU 30A determines whether the pre-registration sensor is on. If the CPU 30A determines that the trailing edge sensor 21 is off and the pre-registration sensor 22 is on (S59: NO, S60: YES), then it is possible that the sheet C has jammed in the process path R3. Hereinafter, a sheet becoming jammed on the process path R3 will be called a "process jam error." Since there are more rollers disposed on the process path R3 than the cassette-feed path R1 and the process path R3 is the region in which the image-forming unit 5 forms images, a sheet is more susceptible to jamming in the process path R3 and a sheet that becomes jammed on this path is more difficult to remove.

Therefore, in S61 the CPU 30A controls the motor drive circuit 31 to apply a reverse-rotation brake to the motor 32 because a reverse-rotation brake has a stronger deceleration force than a short-circuit brake, and displays a message on the display unit 33 indicating that a process jam error has occurred. Subsequently, the CPU 30A ends the rotational control process for the motor. On the other hand, if the CPU 30A determines that the trailing edge sensor 21 is on and the pre-registration sensor 22 is off (S59: NO, S60: NO), then in S62 the CPU 30A controls the motor drive circuit 31 to apply a short-circuit brake to the motor 32, and displays a message on the display unit 33 indicating that a cassette-feed jam has occurred. Because the sensor 22 is off and the sensor 21 is on, there is a possibility that a cassette-feed jam has occurred. Accordingly, the short circuit brake is applied to the motor 32. Subsequently, the CPU 30A ends the rotational control process for the motor.

Conveying abnormalities that occur in the image-forming region (the process path R3) are generally more difficult to resolve than conveying abnormalities occurring in non-image-forming regions. Thus, in the above case, the CPU 30A halts the motor 32 with a relatively strong deceleration force when a conveying abnormality occurs in the image-forming region and halts the motor 32 with a relatively weak deceleration force when a conveying abnormality occurs in non-image-forming regions. In this way, the CPU 30A can minimize shortening of the lifespan of the motor 32 due to halting operations when sheet-conveying abnormalities occur more so than a configuration for halting the motor 32 with the same strong deceleration force regardless of whether the conveying abnormality occurred in the image-forming region. Further, the printer 1 can minimize the amount of unnecessary image formation that continues in the event of a conveying abnormality that occurs in the image-forming region.

Conveying abnormalities are also generally more difficult to resolve when occurring in regions having a large number of conveying rollers. In the embodiment, the CPU 30A halts the motor 32 with a strong deceleration force when the conveying abnormality occurs in a region having a relatively large number of conveying rollers and halts the motor 32 with a weak deceleration force when the conveying abnormality occurs in a region having a relatively small number of conveying rollers. In this way, the printer 1 can suppress shortening of the lifespan of the motor 32 due to halting operations performed in the event of sheet-conveying abnormalities more so than a configuration for halting the motor 32 with the same strong deceleration force regardless of the number of conveying rollers present in the region in which the conveying abnormality occurred.

Discharge Path Process

Figure 8:
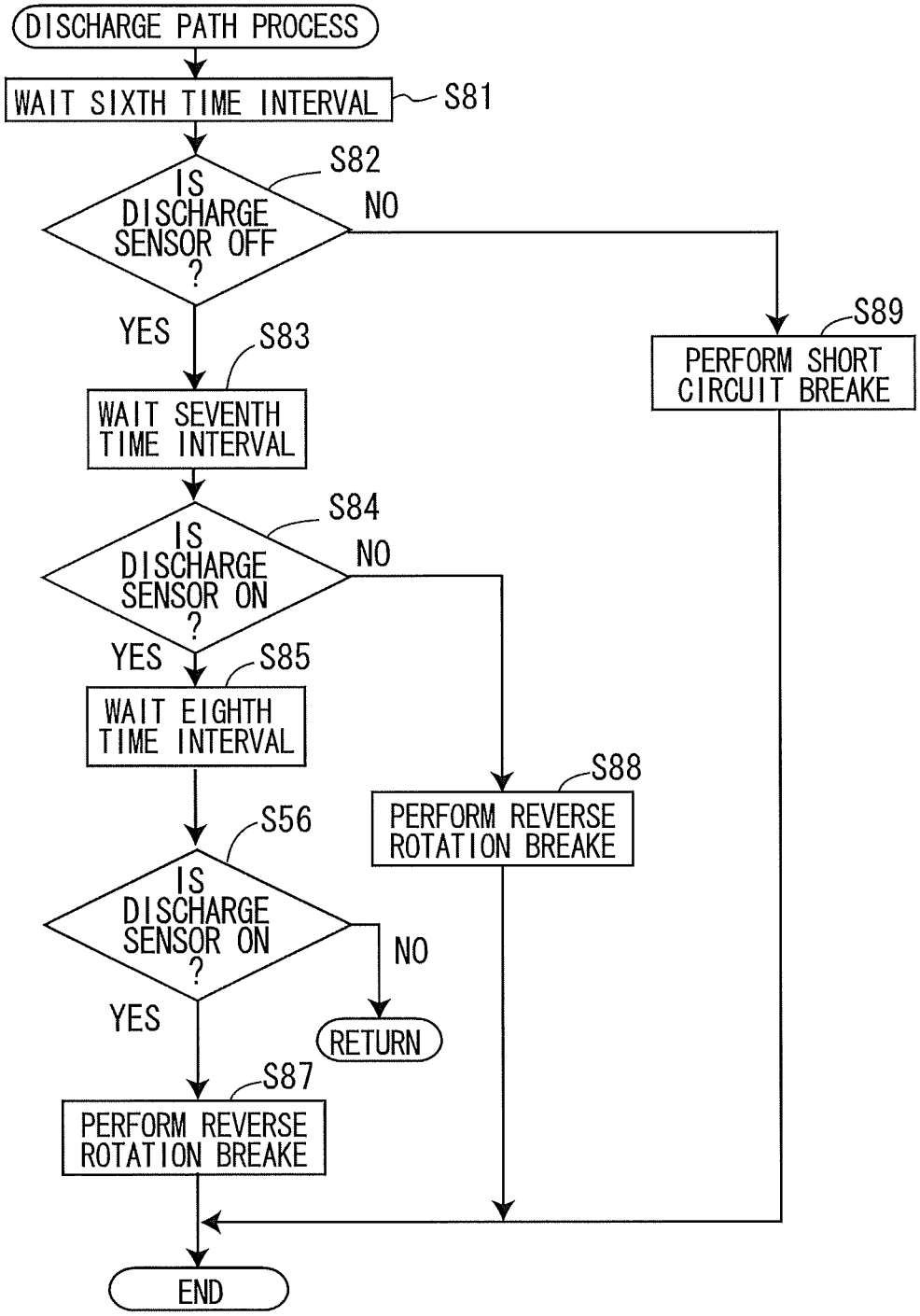
FIG. 8 is a flowchart illustrating a discharge path process.

In S81 at the beginning of the process in FIG. 8, the CPU 30A waits a sixth time interval after initiating rotation of the registration rollers 13 and the like. The sixth time interval is shorter than the length of time required for the leading edge of a sheet C having the minimum dimension described above to arrive at the sensing region of the discharge sensor 24 after initiating rotation of the pick-up roller 12 and the like in S4 of FIG. 4. After waiting the sixth time interval, in S82 the CPU 30A determines whether the discharge sensor 24 is off. If the CPU 30A determines that the discharge sensor 24 is on (S82: NO), then it is possible that the preceding sheet jammed in the discharge path R4. This event is another example of a sheet-present conveying abnormality and hereinafter will be called a "discharge jam error."

Since the discharge path R4 has fewer rollers than the process path R3 and is not a region in which the image-forming unit 5 forms images, paper jams are less likely to occur in the discharge path R4 and are easier to resolve in the event that they do occur. Therefore, in S89 the CPU 30A controls the motor drive circuit 31 to apply a short-circuit brake to the motor 32, and displays a message on the display unit 33 indicating that a discharge jam error has occurred. Subsequently, the CPU 30A ends the rotational control process for the motor.

On the other hand, if the CPU 30A determines in S82 that the discharge sensor 24 is off after waiting the sixth time interval (S82: YES), in S83 the CPU 30A continues to wait for a seventh time interval. The sum of the sixth and seventh time intervals is the time required for the leading edge of a sheet C having the minimum dimension described above to arrive at the sensing region of the discharge sensor 24 after initiating rotation of the pick-up roller 12 and the like in S4 of FIG. 4. In S84 the CPU 30A determines whether the discharge sensor 24 is on after waiting the seventh time interval. If the CPU 30A determines that the discharge sensor 24 is off (S84: NO), then in S88 the CPU 30A controls the motor drive circuit 31 to apply a reverse-rotation brake to the motor 32, and displays a message on the display unit 33 indicating that a process jam error has occurred. Because the discharge sensor 24 is off after waiting the seventh time interval, the sheet is more susceptible to jamming in the process path R3. Accordingly, the reverse-rotation brake is applied to the motor 32. Subsequently, the CPU 30A ends the rotational control process for the motor.

On the other hand, if the CPU 30A determines that the discharge sensor 24 is on after waiting the seventh time interval (S84: YES), then in S85 the CPU 30A continues to wait for an eighth time interval. The sum of the sixth, seventh, and eighth time intervals is the time required for the trailing edge of a sheet C having the maximum dimension described above to exit the sensing region of the discharge sensor 24 after rotation of the pick-up roller 12 and the like was initiated in S4 of FIG. 4. In S86 the CPU 30A determines whether the discharge sensor 24 is still on after waiting the eighth time interval. If the discharge sensor 24 is on (S86: YES), then in S87 the CPU 30A controls the motor drive circuit 31 to apply a reverse-rotation brake to the motor 32, and displays a message on the display unit 33 indicating that a long-sheet error has occurred. Subsequently, the CPU 30A ends the rotational control process for the motor. Because the discharge sensor 24 is on after waiting the eighth time interval, the occurrence of the long-sheet error is more susceptible. Thus, the reverse-rotation brake is applied to the motor 32. However, if the CPU 30A determines that the discharge sensor 24 is off after waiting the eighth time interval (S86: NO), then the CPU 30A determines that the sheet C being discharged has dimensions supported by the printer 1, ends the current discharge path process, and returns to S1 of FIG. 4.

Effects of the Embodiment

Depending on abnormalities in which a sheet is present in different regions of a conveying path, the printer 1 according to the embodiment halts the motor 32 through operations with different deceleration forces. Accordingly, the printer 1 according to the embodiment minimizes shortening of the lifespan of the motor 32 caused by halting operations performed in the event of sheet-conveying abnormalities, more so than a configuration that halts the motor 32 using the same strong deceleration force regardless of the position on the conveying path at which the sheet-conveying abnormality occurred.

While the invention has been described in detail with reference to the embodiments thereof, it would be apparent to those skilled in the art that various changes and modifications may be made therein without departing from the scope of the invention.

The embodiment described above gives an example of an electrophotographic printer 1 as the sheet-conveying device. However, the sheet-conveying device may be an image-forming device other than an electrophotographic-type, such as inkjet-type. Alternatively, the sheet-conveying device may be a printing device; a facsimile machine; a copy machine; a multifunction device having a plurality of functions, such as a scanner function and copier function; and the like. The sheet-conveying device may also be a device for conveying paper currency or the like. In short, the sheet-conveying device may be any device having a conveying unit that conveys sheets with a brushed motor.

In the embodiment, the control unit 30 is used as an example of a controller. However, the controller may be configured of a plurality of CPUs, a hardware circuit such as an application specific integrated circuit (ASIC), or both CPUs and hardware circuits. For example, the controller may be configured to execute any two or more of the processes, such as the process for determining abnormality (S15-S17, S31, S36, S52, S54, S56, S59, S60, S82, S84, S86), the process for halting motor (S18, S19, S37, S58, S61, S62, S87-S89), the process for waiting the fourth time interval (S53), and the process for waiting the fourth and fifth time interval (S54 and S55) on separate CPUs or hardware circuits. The order in which the processes are performed may be adjusted as desired.

In the embodiment described above, the control unit 30 employs four sensors 21-24 to perform rotational control of the motor. However, the control unit 30 need not use all four sensors to implement rotational control. For example, the control unit 30 may be configured to determine that a sheet-present conveying abnormality has occurred if the post-registration sensor 23 is on when the power to the printer 1 is turned on or if the post-registration sensor 23 is on for more than a prescribed time, and may be configured to determine that a sheet-not-present conveying abnormality has occurred if the post-registration sensor 23 is not on even when a prescribed time has elapsed since a print command was received. This configuration is effective for a sheet-conveying device possessing only a single sensor.

The motor drive unit of the embodiment is configured with the H-bridge circuit 35, but the present invention is not limited to this structure. For example, the motor drive unit may be configured of a T-bridge circuit or other circuit capable of driving the motor to rotate in both forward and reverse directions. Alternatively, the motor drive unit may be configured of a circuit that cannot drive the motor to rotate in both forward and reverse directions, but may be configured of a circuit that can execute a plurality of halting operations having differing deceleration forces by modifying the size of the drive current, for example. Hence, the motor drive unit may be configured of any circuit capable of implementing a plurality of halting operations with differing deceleration forces.

In the embodiment, the control unit 30 controls the motor drive circuit 31 to implement three halting operations: a coasting halt, a short-circuit brake, and a reverse-rotation brake. However, the control unit 30 may be configured to execute only two of these three halting operations. Alternatively, the control unit 30 may control the motor drive circuit 31 to combine two or more of the three halting operations described in the embodiment. For example, the control unit 30 may control the motor drive circuit 31 to execute a reverse-rotation brake for a prescribed time interval, followed by a short-circuit brake.

What is claimed is:

1. A sheet conveying device comprising:

a plurality of conveying rollers arranged on a conveying path, the conveying path comprising a first region and a second region different from the first region;

a brushed motor;

a motor drive circuit configured to drive the brushed motor to rotate, and to execute a plurality of halting operations to halt the rotation of the brushed motor, the plurality of halting operations comprising a first halting operation and a second halting operation, the first halting operation outputting an instruction to halt the rotation of the brushed motor, the second halting operation outputting an instruction to drive the motor in a reverse direction of the current rotation of the brushed motor;

at least two sensors configured to detect the presence of the sheet along the conveying path; and a processor comprising hardware, the processor being configured to:

determine, based on the detection result of one of the at least two sensors, whether a condition of conveyance of the sheet in the first region has occurred;

determine, based on the detection result of another one of the at least two sensors, whether a condition of conveyance of the sheet in the second region has occurred;

execute a first specific operation selected from the plurality of halting operations when the processor determines that the condition of conveyance of the sheet in the first region has occurred; and execute a second specific operation selected from the plurality of halting operations when the processor determines that the condition of conveyance of the sheet in the second region has occurred, the second specific operation being different from the first specific operation.

2. The sheet conveying device according to claim 1, further comprising an image forming unit located in the first region and configured to form an image on the sheet located in the first region, wherein in the first specific operation the processor is configured to control the motor drive circuit to halt the brushed motor by a first deceleration force, and wherein in the second specific operation the processor is configured to control the motor drive circuit to halt the brushed motor by a second deceleration force weaker than the first deceleration force.

3. The sheet conveying device according to claim 1, wherein the number of rollers in the first region is larger than the number of rollers in the second region, wherein in the first specific operation the processor is configured to control the motor drive circuit to halt the brushed motor by a first deceleration force, wherein in the second specific operation the processor is configured to control the motor drive circuit to halt the brushed motor by a second deceleration force weaker than the first deceleration force.

4. The sheet conveying device according to claim 3, wherein the processor is configured to select the first specific operation of the plurality of halting operations based on a third detection result of the one of the at least two sensors, wherein the third detection result corresponds to a condition that the sheet is detected throughout a first reference interval from a predetermined time.

5. The sheet conveying device according to claim 4 wherein the processor is configured to select the first specific operation of the plurality of halting operations based on a fourth detection result of the one of the at least two sensors, wherein the fourth detection result corresponds to a condition of a sheet detected throughout a second reference interval after the sheet is detected throughout the first reference interval from the predetermined time.

6. The sheet conveying device according to claim 5, wherein the motor drive circuit does not halt the brushed motor when the processor determines that the one of the at least two sensors detects the sheet throughout the first reference interval from the predetermined time and when the processor determines that none of the at least two sensors detects the sheet throughout the second reference interval after the one of the at least two sensors detects the sheet throughout the first reference interval from the predetermined time.

7. A non-transitory computer readable storage medium storing a set of program instructions installed on and executed by a computer for controlling a sheet conveying device comprising:

a plurality of conveying rollers arranged on a conveying path, the conveying path comprising a first region and a second region different form the first region;

a brushed motor;

a motor drive circuit configured to drive the brushed motor to rotate, and to execute a plurality of halting operations to halt the rotation of the brushed motor, the plurality of halting operations comprising a first halting gyration and a second halting operation, the first halting operation outputting an instruction to halt the rotation of the brushed motor, the second halting operation outputting an instruction to drive the motor in a reverse direction of the current rotation of the brushed motor; and at least two sensors configured to detect the presence of the sheet along the conveying path, the program instructions comprising:

determining, based on the detection result of one of the at least two sensors, whether a condition of conveyance of the sheet in the first region has occurred;

determining, based on the detection result of another one of the at least two sensors, whether a condition of conveyance of the sheet in the second region has occurred;

executing a first specific operation selected from the plurality of halting operations when the condition of conveyance of the sheet in the first region is determined to have occurred; and executing a second specific operation selected from the plurality of halting operations when the condition of conveyance of the sheet in the second region is determined to have occurred, the second specific operation being different from the first specific operation.

* * * * *